United States Patent [19]

Vits et al.

[11] 3,961,882

[45] June 8, 1976

[54] SCULPTURED PRINTING OF NYLON CARPET

[75] Inventors: Helmuth Vits, Greenville; Preston G. Baker, Jr., Taylors, both of S.C.

[73] Assignee: Bigelow-Sanford, Inc., Greenville, S.C.

[22] Filed: July 25, 1974

[21] Appl. No.: 491,654

[52] U.S. Cl. ..... 8/17; 8/168; 8/175; 8/178 R

[51] Int. Cl.[2] ..... D06P 3/24; D06P 5/22; D06Q 1/02

[58] Field of Search ..... 8/17, 178 R

[56] References Cited

UNITED STATES PATENTS

| | | | |
|---|---|---|---|
| 705,977 | 7/1902 | Timme | 8/17 |
| 1,467,136 | 9/1923 | Creasey | 8/14 |
| 2,069,760 | 2/1937 | Hueller | 8/114.6 |
| 2,287,696 | 6/1942 | Miller | 8/17 |
| 2,816,811 | 12/1957 | Tillett et al. | 8/14 |
| 2,875,504 | 3/1959 | White | 28/72 |
| 2,938,811 | 5/1960 | Hermes | 8/166 |
| 3,779,705 | 12/1973 | Kitamura et al. | 8/178 |
| 3,834,868 | 9/1974 | Tatsuoka et al. | 8/DIG. 4 |

FOREIGN PATENTS OR APPLICATIONS

| | | | |
|---|---|---|---|
| 46-41435 | 12/1971 | Japan | 8/DIG. 4 |

OTHER PUBLICATIONS

Diserns, The Chemical Technology of Dyeing and Printing, vol. II, Reinhold Publishing Corp., N.Y., N.Y., 1951, p. 266.

*Primary Examiner*—Ronald W. Griffin
*Attorney, Agent, or Firm*—Burgess, Ryan and Wayne

[57] ABSTRACT

A method is provided for imparting a sculptured design effect to the pile surface of a polyamide fabric by applying to selected areas of the surface of said fabric a printing composition containing about 15 to 40% by weight of resorcinol, about 10 to 15% by weight of sulfuric acid or about 2 to 8% by weight of phenol.

9 Claims, 3 Drawing Figures

SCULPTURED PRINTING OF NYLON CARPET

FIELD OF THE INVENTION

The present invention relates to a new and improved process for imparting a sculptured design effect to the pile surface of a polyamide fabric. More specifically, the present invention is concerned with a method for producing a sculptured effect on a polyamide fiber such as a nylon and to the product which is obtained.

BACKGROUND OF THE INVENTION

Pile fabrics have now achieved a wide degree of public acceptance which is due, to some extent, to their luxurious hand, appearance and warmth. However, up to the present time, one important factor which has inhibited an even greater demand for such fabrics has been the lack of a wide selection of designs particularly, sculptured designs and sculptured multi-colored designs, as compared with the large variety of designs available in other fabric constructions. It appears that the problems associated with the production of interesting, deep, clearly delineated and reproducible designs is that, up to the present time, it has been difficult to produce such desirable designs in a simple but yet inexpensive manner. Consequently, low-cost pile fabrics have generally been esthetically monotonous and uninteresting.

Further, while a number of different procedures have been employed in an attempt to produce pile fabrics having indented designs of various types, such procedures have been objectionable. In one procedure, pile fabrics having designs in the pile formed by fibers of different height have been produced by handsculpturing techniques using, for example, electric shears. Obviously, such a method is unsuitable for large scale production, is subject to inaccuracy and the cost of production, when compared with more mechanical embossing operations, is rather high. Another method for producing embossed pile fabrics involved spinning heat-shrinkable fibers with other textile fibers, weaving the pattern design into a pile fabric using the blended fibers in the pattern area followed by the application of heat to the pile fabric so as to shrink the fibers in the pattern area. Such a procedure is disclosed in U.S. Pat. No. 2,857,652 wherein external heat is used to shrink pile fibers so as to create an artificial fur. Then, in U.S. Pat. No. 2,988,800 a pile fabric containing, in part, shrinkable fibers had its back colored in a pre-determined color pattern. The specific degree of heat absorption of the backing varied in accordance with the color pattern. When heat was applied to the back portion of the fabric, the fibers on the face of the fabric did shrink according to the degree of heat absorption of backing in each color area.

Still another method for producing a pile fabric characterized by a plurality of heights of pile tufts or fibers in the finished article is described in U.S. Pat. No. 2,110,867. In this patent, a pile fabric having a wool or mohair pile is impregnated, in pre-determined pile areas, with a paste containing preferably, calcium thiocyanate. Other materials such as barium, lithium or ammonium thiocyanate were also used. Further, instead of calcium thiocyanate, other suitable materials such as sodium or potassium hydroxide could be used. The paste is applied by use of a print roller, screen, stencil or by block printing. The fabric is then steamed and the fibers shrink in the impregnated areas. Other procedures for producing designs and patterns on fabrics are disclosed in U.S. Pat. Nos. 2,069,760, 2,267,790 and 3,567,548. In these last mentioned patents, a composition is applied to the face of the fabric so as to destroy specific types of fibers in selected areas. In such procedures, no shrinkage is involved.

SUMMARY OF THE INVENTION

The prior art procedures referred to above are generally time consuming and complicated, lack suitable control features and are generally undesirable because of the fairly high manufacturing costs which are involved. However, the objectionable features of said prior art procedures are avoided by the present simple and fairly economical procedure. In the present process, a sculptured design effect is imparted to the pile surface of a polyamide by applying to selected areas of the surface of said fiber, a printing composition containing specified amounts of resorcinol, dilute sulfuric acid or phenol. Particularly suitable polyamides are the various nylons including nylon 6, nylon 66 and the like, including mixtures thereof.

The useful range of resorcinol varies from about 15 to about 40% by weight, of the printing composition, a range of about 20 to 30% being most suitable. If less than the minimum amount of resorcinol is used, the shrinkage is negligible. However, if more than about 40% of resorcinol is used, the polyamide fiber can be either damaged or even destroyed. As for the sulfuric acid, dilute amounts of this material are used and a suitable operative range varies from about 10 to about 15% by weight, of the printing composition. If more than the indicated maximum amount is used, the sulfuric acid will dissolve or degrade the polyamide fiber. If less than the specified minimum amount is used, little or no shrinking is effected.

The useful range of phenol varies from about 2 to about 8% by weight, of the printing composition, 5% being most suitable. If less than the minimum amount of phenol is used, the shrinkage is negligible. However, if more than about 8% of phenol is used, the polyamide fiber can be either damaged or even destroyed.

Insofar as the prior art is concerned, the present process differs from U.S. Pat. No. 2,110,867 in that a different fiber is used in the present process as well as different shrinking chemical materials. Further, in said U.S. Pat. No. 2,110,867, a steaming step is required while in the present process, it may be unnecessary to steam the fabric. The present process is likewise distinguishable from U.S. Pat. No. 2,988,800 in that the pile of the fabric and not the back is treated and additionally, in the present process, heat is not used to effect shrinkage of the fiber.

The printing compositions used in the present process are generally applied in the form of a paste and may contain in addition to the specified amounts of resorcinol sulfuric acid or phenol, the following materials (the percentages are in terms of percentage by weight):

up to 90% water
0.3 – 0.6% of a vegetable gum (Galaxy 758)
0.5% foaming agent
0.25% of an acid generator [1]
up to 2% of an acid dye
0.2% formic acid [2]

1. in the form of a liquid containing a chemical salt. This material generates an acid that is, the material is hydrolyzed to an acid.

2. the acid is used to fix the dye. Acetic acid can also be used.

A printing composition of the type set out above is applied to selected areas of the pile side of a carpet or other pile fabric. The composition containing the resorcinol or sulfuric acid shrinks the polyamide fabric in the selected areas and an embossed design becomes visible in the pile surface. When such a composition is applied to a solid color fabric, only an embossed design is created even though light reflectance from high and low areas may, in some cases, create a visual sense that several colors are present. However, when the composition is used in selected dyes used in printing machines that print a colored design on the fabric, both an embossed and a color design will be visible.

It should be mentioned that any printing equipment can be used to apply the present sculpturing compositions to a pile fabric whether it be by mold, screen, stencil, dye steam, dye drops, or the like. Suitable equipment of this type is disclosed in the following patents:

U.S. Pat. Nos. 2,905,085, 2,997,952, 3,129,442, 3,292,532, 3,393,411, 3,565,003, 3,683,649, 3,717,722 and British 988,978.

When it is desired to dye the fabric, tuft dye equipment that can be used is described in U.S. Pat. Nos. 2,816,811; 2,984,540 and 3,175,488. In one most suitable embodiment of the invention, the equipment described in U.S. Pat. No. 2,816,811 is used. This equipment is illustrated in the accompanying drawing, wherein.

Figure 1:
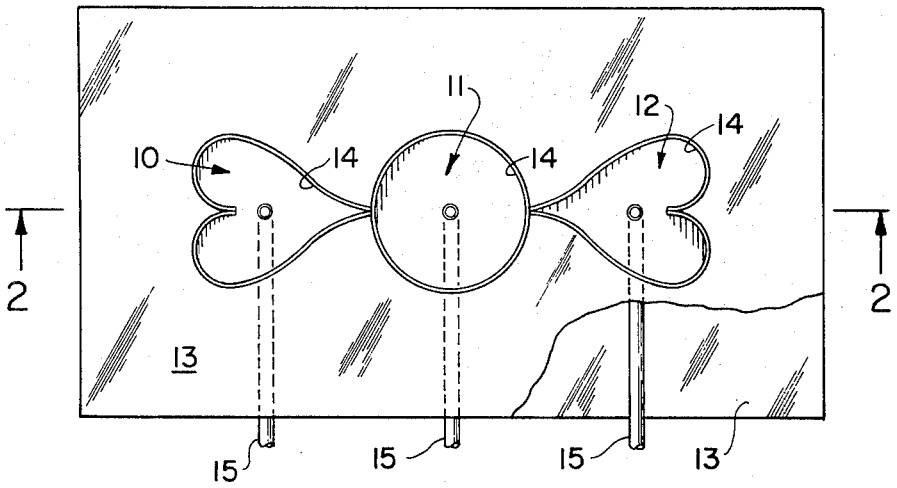
FIG. 1 is a plan view of the dye carrying portion of the apparatus.

In the attached drawing, receptacles 10, 11 and 12 are defined upon base member 13 by free standing walls 14. Each receptacle is leak-proof so that different colors may be carried in the receptacles without intermingling. Provision is made for supplying coloring agents from reserviors to each receptacle through channels 15 which pass through the base member 13. The channels extend from the reservoirs outside of the base member and open into the bottom of each receptacle.

In an embodiment of the invention, in order to dye a design into the pile 16 of a carpet 17, the carpet is placed over the receptacles, pile side downward. The carpeting should be held level or taut. A flat rigid sheet 20 may then be placed over the back of the carpeting in order that the pile be uniformly introduced into the various receptacles. During the period of immersion, additional coloring agent may be fed as may be necessary into the receptacles through channels 15.

Figure 3:
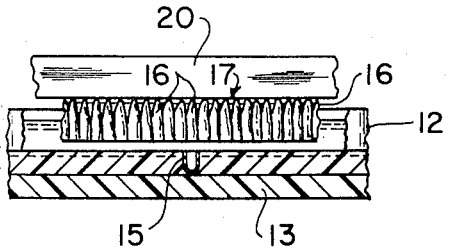
FIG. 3 shows the carpeting in place in the apparatus during immersion.

By making the walls 14 of thin material, it is possible, when pressure is exerted against the back of a carpet, to cause the walls 14 to extend into the pile. When the walls do so extend into the pile, an area of the pile is confined within each receptacle, and each area so confined is isolated from other areas. By this provision, it is possible that coloring of the pile to any desired depth right down to the backing of the carpet is possible, as shown in FIG. 3. All that is necessary is that sufficient coloring agent be introduced into the receptacles during immersion and channels 15 provide means for satisfying this need.

A suitable formulation for use in the present process contains the following ingredients (% by weight of formulation):

Dyes 0.030% Telon Yellow FGL
0.008% Telon Red FL
0.007% Telon Fast Blue A3GL

Chemicals 0.55% Galaxy 758
22.00% Resorcinol
1.00% Acetic Acid
0.50% Nyanthrol DF (a penetrating agent used to lubricate the paste into the nylon fabric).

Figure 2:
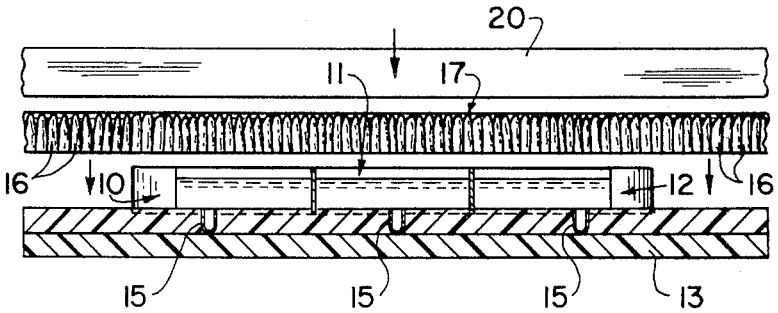
FIG. 2 is a section at 2-2 of FIG. 1 showing carpeting in position for immergence.

The Galaxy 758 thickener is stirred into approximately 80% of the final make-up volume; agitation is continued until the thickener is completely dissolved. There is then added to this mixture, the resorcinol and the mixture is stirred until the resorcinol is completely dissolved. The acetic acid and Nyanthrol DF are added and then the previously boiled dye is added to bring the mixture up to the final volume. Using the equipment set forth in U.S. Pat. No. 2,816,811, the formulation prepared above is fed to receptacle 11 (FIGS. 1 and 2) and the printing composition without the resorcinol is fed to receptacles 10 and 12 (FIGS. 1, 2 and 3). The second printing composition may or may not have a dye or color component. After printing the areas of the pile fabric that had been in contact with the printing composition contained in receptacle 11, the pile fabric is shrunken or is at a lower level than the areas of the pile that had been in contact with the printing composition present in receptacles 10 and 12.

The product obtained by the procedure set out above containing the resorcinol is characterized by a most attractive colored sculptured design.

When the resorcinol is replaced by dilute sulfuric acid (12% sulfuric acid by weight of the composition) or phenol, similarly, a colored sculptured effect is obtained.

Other suitable acid dyes which can be used are:

| Light Tan | Mid Tan |
|---|---|
| .006 Telon Yellow FGL | .016 Telon Yellow FGL |
| .003 Telon Red FL | .007 Telon Red FL |
| .002 Telon Blue A3GL | .006 Telon Blue A3GL |
| **Yellow Beige** | |
| .106 Telon Yellow GRL | |
| .070 Telon Orange RTL | |
| .009 Telon Blue A3GL | |

While the invention has been disclosed in its preferred forms, it is to be understood that the specific embodiments thereof, as described and illustrated herein, are not to be considered in a limiting sense. It would be obvious to one skilled in this art that changes and modifications of the invention can be made without departing from the spirit and scope thereof.

What is claimed is:

1. A process for imparting a sculptured design to the pile surface of a polyamide fabric which consists of applying to substantially less than all of its surface area, a printing composition containing a member selected from the group consisting of resorcinol in an amount varying between about 15 and 40% by weight, dilute sulfuric acid in an amount varying between about 10 and 15% by weight and phenol in an amount varying between about 2 and 8% by weight.

2. A process according to claim 1, wherein the polyamide is nylon 6, nylon 66 or mixtures thereof.

3. A process according to claim 2 wherein the nylon is nylon 6.

4. A process according to claim 1 wherein the resorcinol is present in an amount varying between about 20 and 30% by weight.

5. A process according to claim 4 wherein the resorcinol is present in the printing composition, in an amount equal to about 22% by weight.

6. A process according to claim 1 wherein the phenol is present in an amount equal to about 5% by weight.

7. A process according to claim 1 wherein the printing composition contains a color component sufficient to produce a visible color upon embossing.

8. A process according to claim 7 wherein the color component is an acid dye.

9. A process according to claim 1 wherein sulfuric acid is used in an amount equal to about 12% by weight.

* * * * *